US009394710B2

(12) United States Patent
Hodak

(10) Patent No.: US 9,394,710 B2
(45) Date of Patent: Jul. 19, 2016

(54) FLOW DIVERTING WEIR FOR A SWIMMING POOL SKIMMER

(71) Applicant: Jerry Hodak, Zelienople, PA (US)

(72) Inventor: Jerry Hodak, Zelienople, PA (US)

( * ) Notice: Subject to any disclaimer, the term of this patent is extended or adjusted under 35 U.S.C. 154(b) by 254 days.

(21) Appl. No.: 14/120,436

(22) Filed: Nov. 13, 2013

(65) Prior Publication Data

US 2015/0308137 A1 Oct. 29, 2015

(51) Int. Cl.
*E04H 4/12* (2006.01)
*E04H 4/16* (2006.01)

(52) U.S. Cl.
CPC ..... *E04H 4/1254* (2013.01); *E04H 4/16* (2013.01)

(58) Field of Classification Search
CPC ..... E04H 4/1254; E04H 4/16
USPC ..... 210/167.18, 232
See application file for complete search history.

(56) References Cited

U.S. PATENT DOCUMENTS

| | | | | |
|---|---|---|---|---|
| 3,152,076 | A | 10/1964 | Kreutzer | |
| 4,140,634 | A | 2/1979 | Harry | |
| 4,369,109 | A | 1/1983 | Edge | |
| 4,379,749 | A | 4/1983 | Roth | |
| 4,734,189 | A | 3/1988 | Page, Jr. | |
| 5,059,314 | A | 10/1991 | Beckman | |
| 5,391,296 | A | 2/1995 | Rotundo et al. | |
| 5,392,472 | A | 2/1995 | Maxfield | |
| 5,510,020 | A | 4/1996 | Gronlund | |
| 5,753,113 | A | 5/1998 | Hendricks | |
| 5,804,064 | A * | 9/1998 | Desrochers | E04H 4/1254 210/167.18 |
| 6,315,911 | B1 | 11/2001 | Radsky | |
| 7,005,063 | B2 | 2/2006 | Hodak | |
| 7,390,402 | B1 | 6/2008 | Rhoades, Sr. | |
| 2010/0089842 | A1 * | 4/2010 | Hernandez | E04H 4/1254 210/776 |
| 2014/0197115 | A1 * | 7/2014 | Hargis | E04H 4/1274 210/776 |

FOREIGN PATENT DOCUMENTS

| | | |
|---|---|---|
| CA | 2131320 | 8/1994 |

OTHER PUBLICATIONS

Confer Plastics Inc., Skim-IT, Printed in U.S.A., Publication Date Unknown.

* cited by examiner

*Primary Examiner* — Fred Prince
(74) *Attorney, Agent, or Firm* — James Ray and Assocs; Alexander Pokot

(57) ABSTRACT

A flow diverting weir device includes a mounting member having a length thereof sized to fit under a compression and without use of fasteners into a skimmer opening of a swimming pool skimmer, and an arm having one end thereof fastened to the mounting member, the arm movable between a coiled position and an uncoiled position, wherein the arm extends outwardly from the skimmer opening in the uncoiled position. Arm may be manufactured form a flexible material and have an arcuate cross-section in a plane normal to a length thereof.

15 Claims, 4 Drawing Sheets

FLOW DIVERTING WEIR FOR A SWIMMING POOL SKIMMER

FIELD OF THE INVENTION

The present invention relates, in general, to swimming pools and, more particularly, this invention relates to a flow diverting weir for a swimming pool skimmer.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

As is generally well known, skimmer baskets with openings are provided in above ground or in ground pools to evacuate floating debris in such pools. Prior to the conception and development of the instant invention efforts have been made to improve skimming of the floating debris into a skimmer basket. However, there is a need for an improved flow diverting weir for a swimming pool skimmer that is easy to install and adjust.

SUMMARY OF THE INVENTION

The invention provides a mounting member sized for insertion into an opening of a pool skimmer frame and an elongated arm having a proximal end thereof at least temporarily secured to the surface of the mounting member 20 and extending in a direction generally normal to the plane of the pool skimmer frame.

OBJECTS OF THE INVENTION

It is, therefore, one of the primary objects of the present invention to provide a flow diverting weir for a swimming pool skimmer.

Another object of the present invention is to provide a flow diverting weir for a swimming pool skimmer that does not require fasteners during installation into skimmer opening.

Yet another object of the present invention is to provide a flow diverting weir for a swimming pool skimmer that is easy to adjust in length.

A further object of the present invention is to provide a flow diverting weir for a swimming pool skimmer that can be installed with skimmer openings of different heights.

Yet a further object of the present invention is to provide a flow diverting weir for a swimming pool skimmer that is cost effective to manufacture.

An additional object of the present invention is to provide a flow diverting weir for a swimming pool skimmer that is easy to store when not in use.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
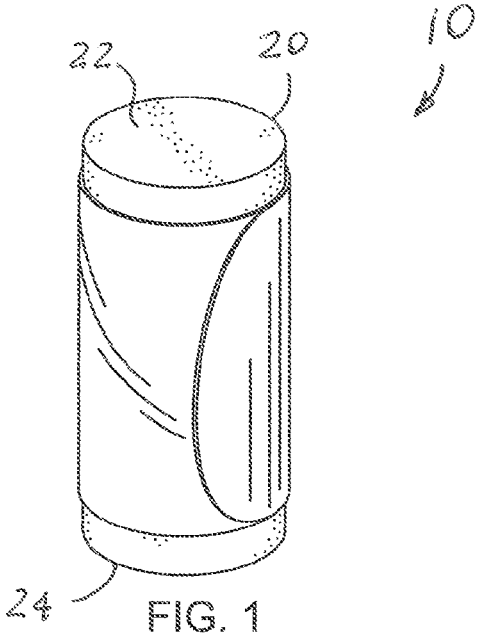
FIG. 1 is one perspective view of a flow diverting weir for a swimming pool skimmer, particularly showing a skimmer arm in a coiled position.
Figure 2:
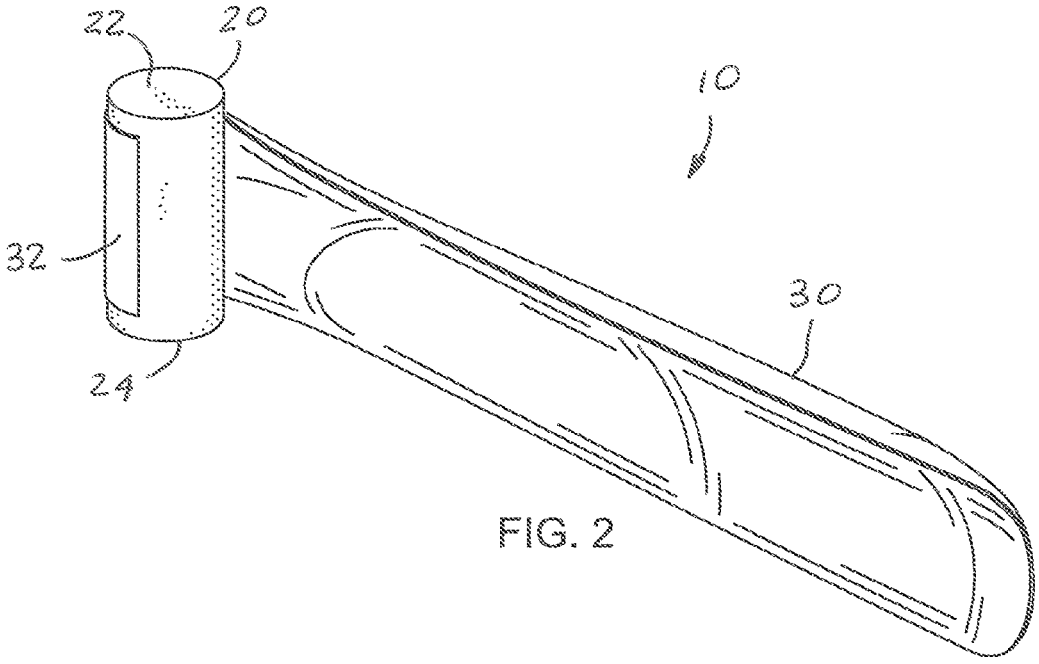
FIG. 2 is another perspective view of the flow diverting weir of FIG. 1, particularly showing the skimmer arm in an extended position.

Prior to proceeding to the more detailed description of the present invention, it should be noted that, for the sake of clarity and understanding, identical components which have identical functions have been identified with identical reference numerals throughout the several views illustrated in the drawing figures.

Now in reference to FIGS. 1-10, therein is shown a flow diverting weir device, hereinafter referred to as a "device", generally designated as 10, for a conventional swimming pool skimmer 2 that has a frame 4 with an opening 6 defining an interior peripheral edge 8.

Figure 3:
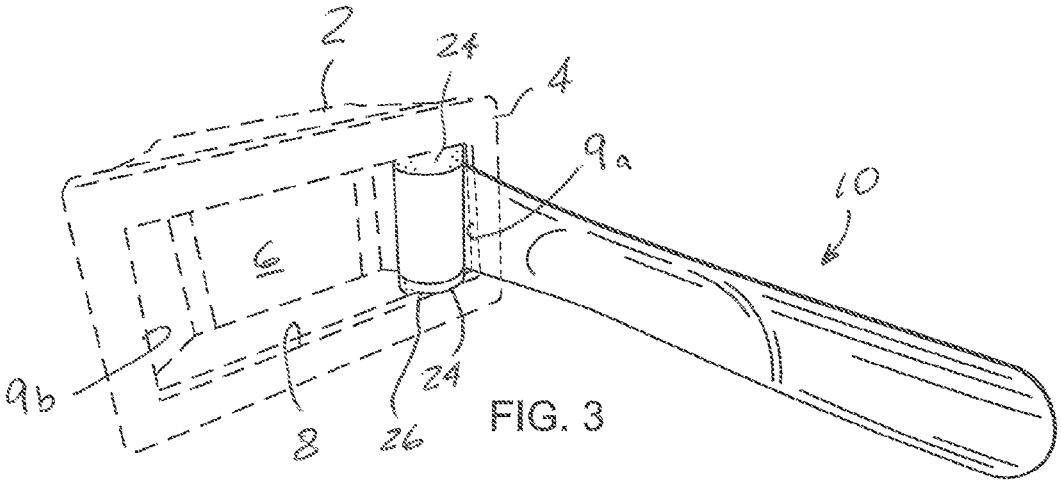
FIG. 3 is a perspective environmental view of the flow diverting weir of FIG. 2 installed into an opening of a swimming pool skimmer, shown in broken lines.
Figure 11:
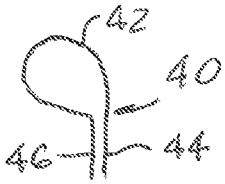
FIG. 11 is a planar view of an optional clip employed to at least temporarily fix extended length of the skimmer arm of the flow diverting weir in FIGS. 1-2.
Figure 4:
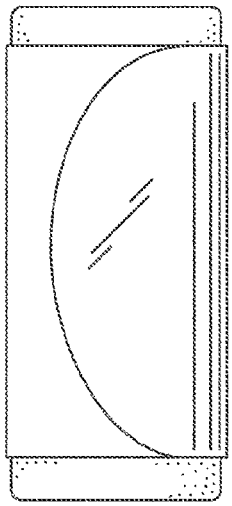
FIG. 4 is a front elevation view of the flow diverting weir in FIG. 1.
Figure 5:
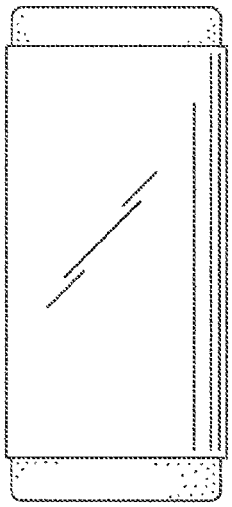
FIG. 5 is a rear, left side or right side elevation view of the flow diverting weir in FIG. 1 and left side elevation view of the flow diverting weir in FIG. 2.
Figure 6:
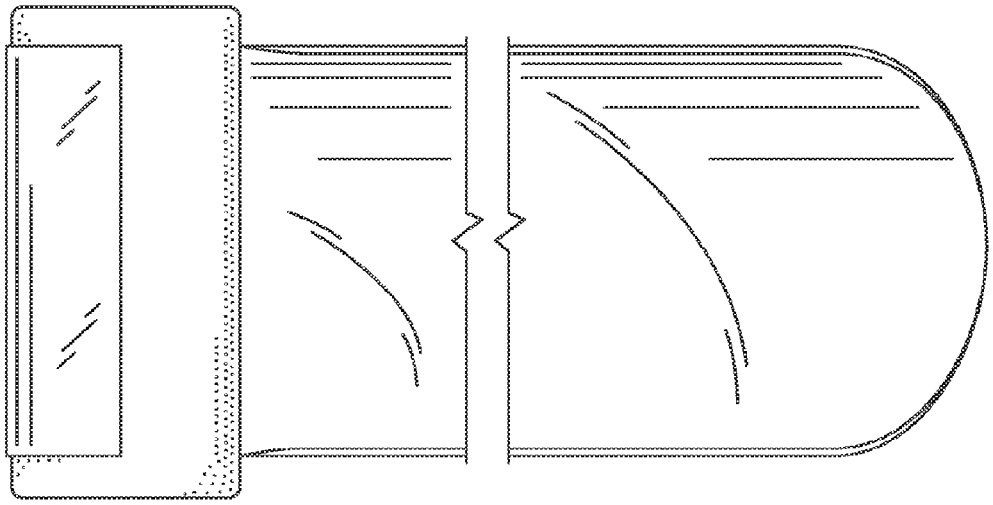
FIG. 6 is a front elevation view of the flow diverting weir in FIG. 2.
Figure 7:
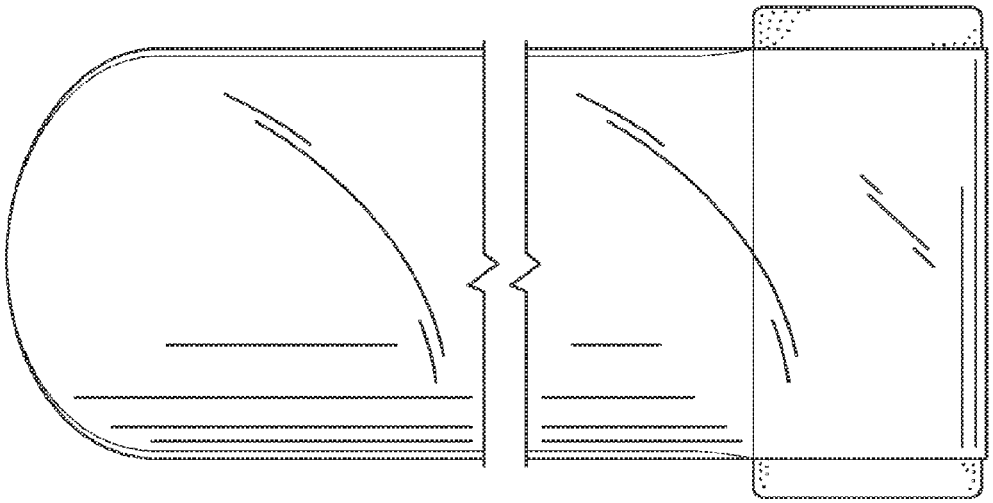
FIG. 7 is a rear elevation view of the flow diverting weir in FIG. 2.
Figure 8:
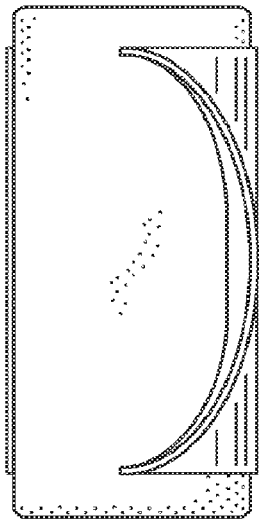
FIG. 8 is a right side elevation view of the flow diverting weir in FIG. 2.
Figure 9:
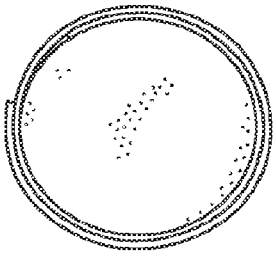
FIG. 9 is a top or bottom plan view of the flow diverting weir in FIG. 1.
Figure 10:
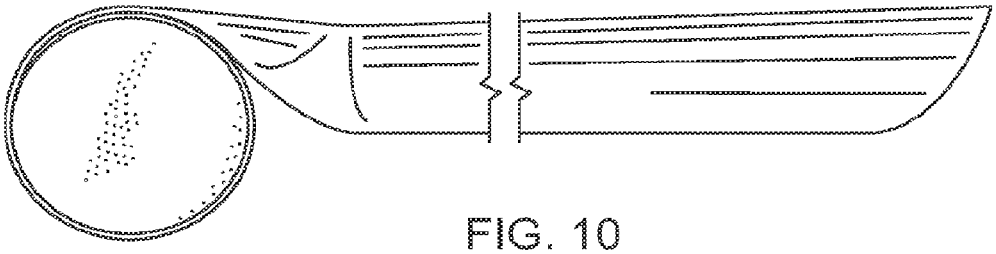
FIG. 10 is a top or bottom plan view of the flow diverting weir in FIG. 2.

The device 10 comprises a mounting member 20 which has an elongated shape being positioned generally vertical within the opening 6. More particularly, the mounting member 20 is preferably manufactured as a cylindrical member from a combination of polypropylene and Styrofoam materials. It has been found that such material combination is advantageous for installing the mounting member 20 within the opening 6 without any fasteners or additional components and therefore, without, any tools. This fastener free installation is achieved by the compression of the ends 22, 24 of the mounting member 20 upon direct contact with respective portions of the interior peripheral edge 8. The linear indentations or cavities 26, at least temporarily defined within a surface of one or both ends 22, 24 by a respective edge portion of the interior peripheral edge 8 being essentially inset into the length of the mounting member 20 after such mounting member 20 is installed into the opening 6, provide means for preventing the mounting member 20 from disengaging the frame 4 of the pool skimmer 2. By way of an example only, FIG. 3 illustrates such linear indentation or cavity 26 only in the bottom edge 24. It is to be understood that the mounting member 20 may be also installed under a compression sufficient to prevent disengagement thereof during use but that does not define such linear indentations or cavities 26.

Furthermore, such material combination is further advantageous in accommodating openings 6 of various heights with a single length of the mounting member 20 due to a compression thereof.

Yet, such material combination has been found advantageous in easily removing the mounting member 20 either for storage purpose or for the purpose of preventing an obstruction during use of a pool (not shown) having such pool skimmer 2 installed in and for reinstalling the device 10 in the same or different pool skimmer.

Although the mounting member has been illustrated as a solid cylinder, the instant invention contemplates use of a tubing type material as well as use of cross-sectional shapes other than round or ring (tubular).

Another essential element of the device 10 is another elongated member or the arm 30 which is constructed from a material allowing such arm 30 to move between a coiled position around the peripheral surface of the mounting member 20, as best shown in FIG. 1 and an extended position, as best shown in FIG. 3.

The proximal end 32 of the arm 30 may be fastened to the peripheral surface of the mounting member 20 by any conventional means, such as fasteners, adhesives, hook and loop fastener and the like.

The width of the arm 30 is smaller than the length (or height) of the mounting member 20 so as to allow compression at each end 22, 24 thereof during installation and use.

Preferably the arm 30 is manufactured from a Cellulose Acetate Butyrate (CAB), commonly known as butyrate, which is resistant to ultraviolet rays, has a lower moisture absorption than acetate and has an extremely high impact strength.

Furthermore, CAB is characterized by a good strength, toughness, and high surface gloss. It resists weathering and has excellent transparency. Such CAB may be provided by Emco Industrial Plastics, Inc under the brand names Tenite®, Uvex®, Excelon®, and Spartech®.

It has been found advantageous to provide arm 30 as having an arcuate cross-sectional shape in a plane normal to a length of the arm 30. It has been further found that such CAB material has flexibility and memory characteristics, sufficient to allow the arm 30 to flatten while being coiled around the peripheral surface of the mounting member 30 yet retain the arcuate shape when being in extended position as viewed in FIGS. 2-3. Arcuate cross-sectional shape of the arm 30 facilitates/improves collection of debris and movement of the debris into the skimmer current.

In use, as best viewed in FIG. 3, the arm 30, which is generally in a coiled position during storage and transport is uncoiled to a desired length and the mounting member 20 is wedged or fitted under compression into the opening 6 so that the exterior surface of the arm 30 abuts a vertical portion 9*a* of the inner peripheral edge 8. In this arrangement, such vertical portion provides resistance to the arm 30 and maintains such arm 30 in a direction being generally normal to the front plane of the frame 4. The abutting relationship with the vertical portion 9*a* of the inner peripheral edge 8 is also advantageous in providing a stop to a partially coiled/partially extended arm 30. Positioning of the mounting member 20 in relationship to the vertical portion 9*a* of the peripheral edge 8 determines the angle at which the arm 30 is inclined relative to the plane of the frame 4 with the angle reducing in value as the mounting member 20 moves further away from the vertical portion 9*a* that the arm 30 faces during installation and toward the opposite vertical portion 9*b*.

Alternatively, the instant invention contemplates that an optional stop, for example such as a pressure clip 40 having a curved portion 42 sized and shaped to be disposed on the external surface of the mounting member 20 or the portion of the arm 30 being coiled thereon and a pair of straight legs 44, 46 extending a distance along both surfaces of the arm 30, can be employed for selecting the desired extended length of the arm 30 while affording positioning of the mounting member anywhere within the opening 6. In use, such clip 40 applies force onto both the arm 30 and the mounting member 20 so as to prevent re-coiling movement of the arm 30.

The clip 40 can be manufactured from a thin wire-like material with a round cross-section or as having an elongated cross-section. The clip 40 is preferably attached onto device 10 from either end 22, 24 of the mounting member 20. The clip 40 may be also employed in maintaining the arm 30 in a coiled position during storage or transportation.

It is also contemplated that other stops can be employed with the device 10 so as to eliminate the need to position the exterior surface of the arm 30 against the vertical portion 9*b*.

Thus, the instant invention provides a flow diverting weir 10 that is easy and simple to install without tools and adjustments within pool skimmer openings of different sizes (heights) and that includes a light weight, flexible and impact resistant curved arm, whose operative length can be adjusted or selected during installation.

The invention claimed is:

1. A flow diverting weir device, comprising:

a mounting member manufactured from a combination of polypropylene and styrofoam materials and having a length thereof sized to fit under a compression and without use of fasteners into a skimmer opening of a swimming pool skimmer; and an arm having one end thereof fastened to said mounting member, said arm movable between a coiled position and an uncoiled position, wherein said arm extends outwardly from the skimmer opening in said uncoiled position.

2. The flow diverting weir device of claim 1, wherein said arm is manufactured from a butyrate material sufficient in allowing said arm to flatten while being in said coiled position around a peripheral surface of said mounting member and allowing said arm to have an arcuate cross-section in a plane normal to a length thereof while being in said uncoiled position.

3. The flow diverting weir device of claim 1, wherein said arm includes an arcuate cross-section in a plane normal to a length thereof.

4. The flow diverting weir device of claim 1, wherein said arm abuts a side surface of the skimmer opening while in said uncoiled position.

5. The flow diverting weir device of claim 1, wherein a length of said arm is adjustable.

6. The flow diverting weir device of claim 1, further comprising a stop configured to maintain said arm in a partially coiled or a partially extended position.

7. The flow diverting weir device of claim 1, wherein said stop includes an abutting relationship between a surface of said arm and a side surface of the skimmer opening.

8. The flow diverting weir device of claim 1, wherein said stop includes a clip having a curved portion thereof being sized and shaped to be disposed on an external surface of said mounting member or a portion of said arm being coiled thereon and a pair of straight legs extending a distance along both surfaces of said arm.

9. The flow diverting weir device of claim 8, wherein said clip applies force onto said arm being in said uncoiled position and said mounting member, said force sufficient to prevent a re-coiling movement of said arm.

10. The flow diverting weir device of claim 1, wherein said stop is operable to select an extended length of said arm.

11. A flow diverting weir device, comprising:

a mounting member having a length thereof sized to fit under a compression and without use of fasteners into a skimmer opening of a swimming pool skimmer; and an arm comprising an arcuate cross-section in a plane normal to a length thereof and being manufactured from a flexible material, said arm having one end thereof fastened to said mounting member, said arm movable between a coiled position and an uncoiled position, wherein said arm extends outwardly from the skimmer opening in said uncoiled position.

12. The flow diverting weir device of claim 11, wherein said mounting member is manufactured from a combination of polypropylene and styrofoam materials.

13. A flow diverting weir device, comprising:

a mounting member manufactured from a combination of polypropylene and styrofoam materials and having a length thereof sized to fit under a compression and without use of fasteners into a skimmer opening of a swimming pool skimmer;

an arm comprising an arcuate cross-section in a plane normal to a length thereof and being manufactured from a flexible material, said arm having one end thereof fastened to said mounting member, said arm movable between a coiled position and an uncoiled position, wherein said arm is configured to extend outwardly from the skimmer opening in said uncoiled position; and a stop configured to maintain said arm in a partially coiled or a partially extended position.

14. The flow diverting weir device of claim 13, wherein said arm is manufactured from a butyrate material.

15. The flow diverting weir device of claim 13, wherein said arm is manufactured from a butyrate material sufficient in allowing said arm to flatten while being in said coiled position around a peripheral surface of said mounting member and allowing said arm to have an arcuate cross-section in a plane normal to a length thereof while being in said uncoiled position.

* * * * *